US006024108A

United States Patent [19]

Kuo et al.

[11] Patent Number: 6,024,108

[45] Date of Patent: Feb. 15, 2000

[54] UNFOLDED UMBRELLA WITH AN IMPROVED OPENING STRUCTURE

[76] Inventors: Cheng Miao Ling Kuo, 8F, No. 39, Sau Nien Street, Hsinchu; Sheng Ho Wang, No. 75, Ann Mei Road, Goin Gan, Ho Li, Taichung Shien, both of Taiwan

[21] Appl. No.: 09/081,083

[22] Filed: May 19, 1998

[51] Int. Cl.[7] ..... A25B 25/14

[52] U.S. Cl. ..... 135/24; 135/28; 135/38

[58] Field of Search ..... 135/15.1, 19.5, 135/20.3, 22, 24, 28, 37–39

[56] References Cited

U.S. PATENT DOCUMENTS 5,390,686 2/1995 Lin ..... 135/24

5,758,677 6/1998 Wang ..... 135/24

5,816,276 10/1998 Seidel ..... 135/24

*Primary Examiner*—Beth Aubrey

*Attorney, Agent, or Firm*—Rosenberg, Klein & Lee

[57] ABSTRACT

An improved opening structure of an unfolded umbrella includes a shaft with an upper mounting ring, a runner around the shaft, a frame having many ribs connected with the upper mounting ring and the runner, a button mounted on the shaft to engage with the runner for closing the umbrella. A rod is provided in the shaft at a lower position, an aperture is formed on the shaft with a wheel, and an elastic rope having one end connected with the rod and the other end extending upward to pass by the wheel, and to connect with the runner. When the umbrella is closed, the elastic rope is stretched that obtains a recovering force to open the umbrella quickly and automatically when the runner is unlocked.

1 Claim, 2 Drawing Sheets

UNFOLDED UMBRELLA WITH AN IMPROVED OPENING STRUCTURE

BACKGROUND OF THE INVENTION

A prior art unfolded umbrella is capable of being opened automatically by providing a plurality of springs in a shaft and between a frame and a runner of the umbrella. When the umbrella is closed, the runner is stopped at a lower position of the shaft by a hook in a button mounted on a handle, which is connected with the shaft. When pressing the button, the runner is unlocked and will be moved upward to open the umbrella by use of force of the springs. The above known structure includes many springs that increases the total weight of the umbrella and the assembling procedure is complex and troublesome. Moreover, this known umbrella could be rusted and broken easily and costs high.

OBJECT OF THE INVENTION

The main object of the present invention is to provide an improved opening structure of an unfolded umbrella, which includes a single elastic rope for quickly opening the umbrella and being connected easily.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
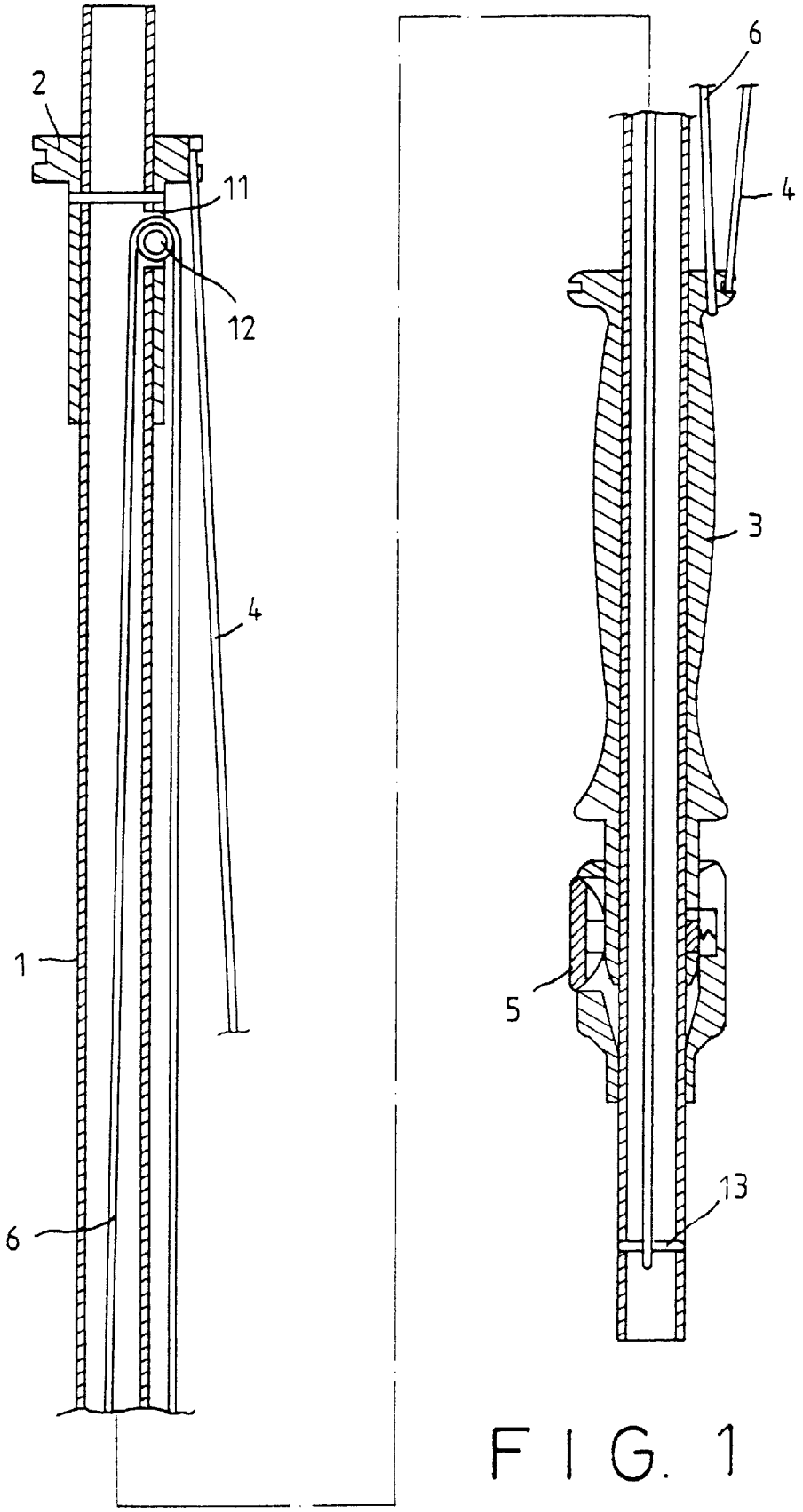
FIG. 1 is a cross sectional plan view of an unfolded umbrella in closed state according to the present invention.
Figure 2:
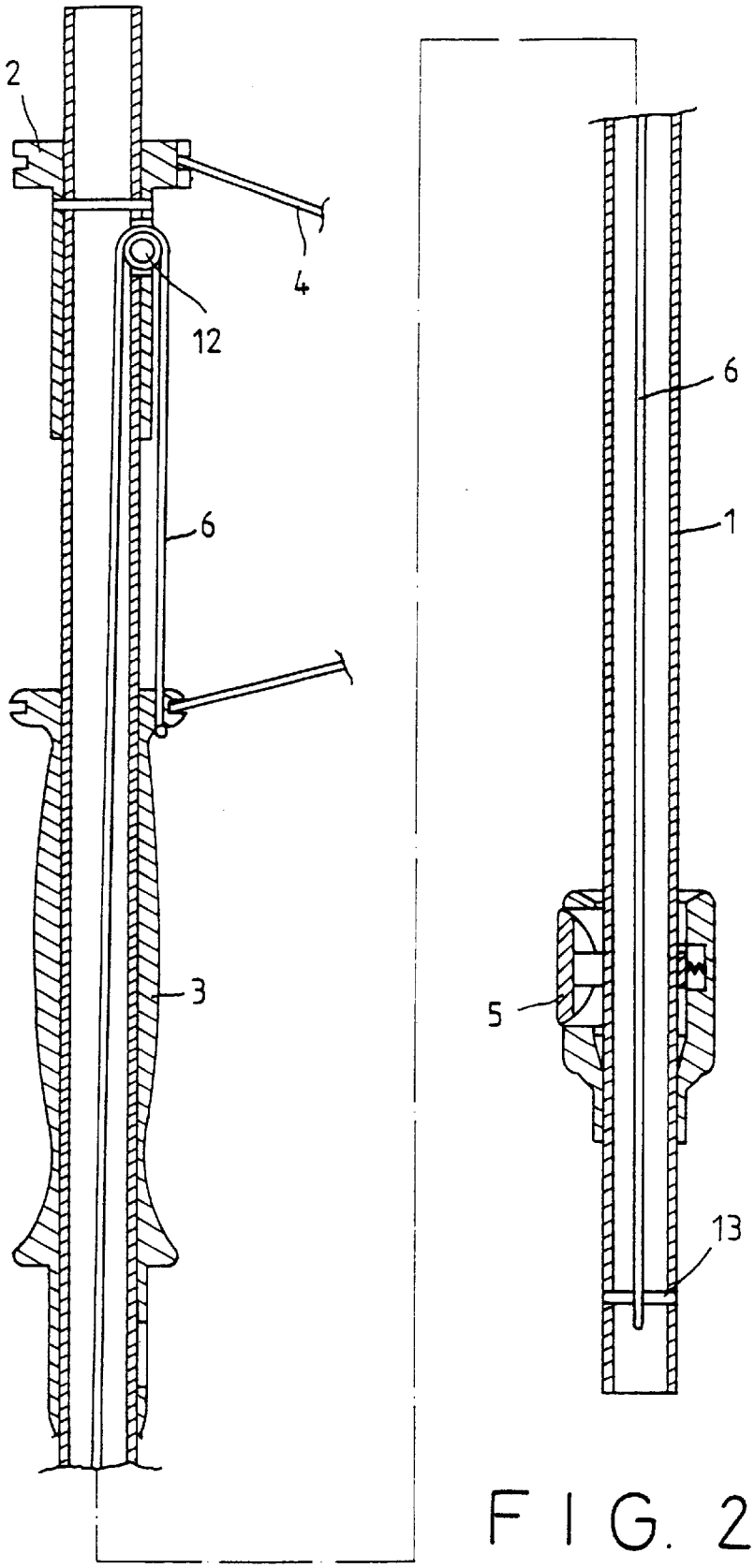
FIG. 2 is a cross sectional plan view of FIG. 1 in opened state of the present invention.

Please refer to FIG. 1, the present invention is an improvement of an unfolded umbrella, which includes a shaft (1), an upper mounting ring (2), a slidable runner (3), and many ribs

(4) becoming a frame connected with the upper ring (2) and the runner (3). A control button (5) is mounted at a lower position near a handle of the umbrella. It is a characteristic that an aperture (11) is formed at a top position of the shaft (1) and a wheel (12) is provided in the aperture (11). A rod (13) is connected with the shaft (1) at its lower end. An elastic rope (6) connects its one end with the rod (13) and extends the other end upward to pass by the wheel (12) and connect with a top position of the runner (3). In closed state of the umbrella, the runner (3) is locked by the button (5) and the elastic rope (6) is stretched with recovering force. As the button (5) is pressed, die ninner (3) being unlocked will be moved upward quickly by the force of the elastic rope (6). Accompanying the movement of the ribs (4) of the frame, the umbrella is then automatically opened.

From above description, it is to be understood that the present invention uses the elastic rope, which are very simple and light, instead of the known complex and heavy springs. Accordingly, it can be found that the present invention obtains an obvious improvement for overcoming the known drawback. Thus, the present invention should be approved and allowed for patent.

I claim:

1. An improved opening structure of an unfolded umbrella including a shaft with an upper mounting ring, a runner provided around the shaft, a frame having many ribs connected with the upper mounting ring and the runner, a button mounted on a lower position of the shaft to engage with the runner for closing the umbrella; characterized in that:

a rod connected with the shaft at a lower position, an aperture formed on the shaft at a top position being provided with a wheel, and an elastic rope having its lower end connected with the rod and the other end extending upward to pass by the wheel, to go through the aperture, and then to connect with the runner for providing a recovering force to open the umbrella quickly and automatically when it is closed.

* * * * *